US007730694B1

(12) United States Patent
Simpson et al.

(10) Patent No.: US 7,730,694 B1
(45) Date of Patent: Jun. 8, 2010

(54) SLIDING CLIP WITH EXTENDED TRAVEL

(75) Inventors: Harold G. Simpson, Tulsa, OK (US); Leo E. Neyer, Edmond, OK (US)

(73) Assignee: Harold Simpson, Inc., Edmond, OK (US)

( * ) Notice: Subject to any disclaimer, the term of this patent is extended or adjusted under 35 U.S.C. 154(b) by 1134 days.

(21) Appl. No.: 11/176,078

(22) Filed: Jul. 6, 2005

Related U.S. Application Data

(60) Provisional application No. 60/586,342, filed on Jul. 7, 2004.

(51) Int. Cl.
*E04D 1/34* (2006.01)

(52) U.S. Cl. ..... 52/713; 52/520; 52/544; 52/547

(58) Field of Classification Search ..... 52/543, 52/544, 545, 551, 288.1, 520, 573.1, 713, 52/715, 546, 547, 550; 24/289, 293, 294, 24/295, 563
See application file for complete search history.

(56) References Cited

U.S. PATENT DOCUMENTS 3,512,222 A * 5/1970 Tinnerman ..... 24/561
3,998,019 A 12/1976 Reinwall, Jr.
4,034,532 A 7/1977 Reinwall, Jr.
4,193,247 A 3/1980 Heckelsberg
4,296,581 A 10/1981 Heckelsberg
4,361,998 A 12/1982 Ellison et al.
4,435,937 A * 3/1984 Stone ..... 52/520
4,467,586 A * 8/1984 Long et al. ..... 52/748.1
4,514,952 A * 5/1985 Johansson ..... 52/713
4,575,983 A 3/1986 Lott, Jr. et al.
4,594,823 A 6/1986 Hague
4,796,403 A * 1/1989 Fulton et al. ..... 52/713
5,001,882 A * 3/1991 Watkins et al. ..... 52/547
5,127,205 A * 7/1992 Eidson ..... 52/520
5,222,341 A * 6/1993 Watkins et al. ..... 52/547
5,511,354 A * 4/1996 Eidson ..... 52/544
5,606,838 A 3/1997 Hughes et al.
5,697,197 A * 12/1997 Simpson ..... 52/462
5,743,063 A * 4/1998 Boozer ..... 52/713
5,867,959 A * 2/1999 Ruble et al. ..... 52/545
5,911,663 A * 6/1999 Eidson ..... 52/520
6,315,489 B1 * 11/2001 Watanabe ..... 403/381
6,367,220 B1 * 4/2002 Krause et al. ..... 52/512
6,715,256 B1 * 4/2004 Fischer ..... 52/713
2006/0174571 A1 * 8/2006 Panasik et al. ..... 52/478

* cited by examiner

*Primary Examiner*—David Dunn
*Assistant Examiner*—Jessie Fonseca
(74) *Attorney, Agent, or Firm*—Bill D. McCarthy; Fellers, Snider, et al.

(57) ABSTRACT

An improved sliding clip for a standing seam roof, the clip having a clip base supporting a clip tab adapted to connect to a standing seam, the clip tab slidably supported by the clip base along a slide track on the clip base, the clip tab permitted to travel a selected range along substantially the full length of the clip base so that the length of the travel path can exceed or be less than the length of the clip base. Stop members on the clip base and clip tab are positioned to abut when the clip tab is moved in either direction along the slide track. Alternate tab stops can be provided to selectively determine the extent of travel of the clip tab along the travel path.

25 Claims, 6 Drawing Sheets

SLIDING CLIP WITH EXTENDED TRAVEL

RELATED APPLICATION

The present application claims priority to U.S. Provisional Application No. 60/586,342 filed Jul. 7, 2004, entitled Sliding Clip For A Standing Seam Roof.

BACKGROUND OF THE INVENTION

1. Field of the Invention

The present invention relates to the field of metal buildings, and more particularly but not by way of limitation, to sliding clips of expanded travel range to accommodate environmental temperature variations on standing seam metal roof assemblies.

2. Discussion

Standing seam metal roofs are formed from interconnected panels supported by underlying support structures, which are usually purlins or joists that are supported by column members extending upwardly from the building foundation. Standing seams are formed at the interconnected edges of the roof panels.

The established practice in the metal building industry has been to provide hold-down clips that connect to the roof panels at the standing seams and are affixed to the underlying purlins or joists. The standing seams of the panels are usually sealed to eliminate or minimize the invasion of moisture from the environment through the standing seams into the protected building interior. Such sealing is difficult to achieve, and is made even more difficult by the expansion and contraction of the roof panels with environmental temperature variations to which the roof is subjected.

In anticipation of the movement of the roof panels with temperature variations, floating clips, also referred to as sliding clips, are utilized to provide a sliding connection between a hold-down clip portion, referred to as the clip tab, and a base portion of the clips, with the clip tabs connected to the standing seams and the base portions secured to the underlying support structure.

Even with the use of floating or sliding clips, the problem of roof panel creep with temperature variations has not been totally solved, largely because prior art sliding clips have not provided sufficient clip travel to accommodate the full range of panel expansion and contraction experienced over the large temperature ranges encountered by large standing seam roof assemblies. For one thing, the more that panel travel is allowed for in a clip design, the greater must be the length of either the clip tab or the supporting clip base, and greater length clip design results in higher costs.

U.S. Pat. No. 4,575,983 teaches proportioning the travel distance of a roof assembly by means of a sliding clip such that a greater amount of panel travel in one direction is permitted, while accommodating less panel travel movement in the opposite direction. However, this patent does not deal with accommodating a greater total panel travel for a given clip.

Generally, floating clips in the past have allowed equal amounts of movement for expansion and contraction, the movement of the hold-down portion relative to the clip base portion being limited by stops on the clip base. Such stops are necessary to keep the upper clip tabs and the lower clip bases together. Responsive to ambient or internal temperature changes, the interconnected metal panels expand and contract, and the floating clips allow for such dimensional changes and for panel travel. However, the range of clip travel (the travel of the sliding clip tab) is contained within the total length of the clip base or of the clip tab.

Although obvious to the most casual observer, one thing is generally overlooked, and that is: the frame, purlins and panels of a pre-engineered building are generally erected at substantially the same temperature. This occurs because the building components are erected before the heating and cooling equipment is installed. Normally, a layer of insulation is placed between the purlins and the panels, and it is only following this installation that substantial differential expansion and contraction occurs between the roof or wall panels and the underlying support structure.

Certain information is required to accurately predict the relative movement that a sliding clip will encounter in service. These include, 1) the temperature to which the building components will be subjected during erection of the building; 2) the maximum and minimum temperatures to which the building interior will be subjected during the life of the building; and 3) the maximum and minimum temperatures to be encountered by the building components during the life of the building. It will be appreciated that these information items are extremely difficult, if not impossible, to foreknow, and it behooves the clips to accommodate maximum clip movement from a neutral point.

Therefore, in selecting a clip for a particular building to be constructed, it is clear that, not only must the selected clip and its attachments to the panel and to the underlying support structure be adequate, the clip tab must also be capable of sliding at a force less than that required to slide the clip tab in the panel seam. If the force to effect movement of the clip tabs relative to their bases is greater than the force to cause the clip tabs to slide in the panel seams, the resultant movement of the clip tabs in the seams will degrade the seam sealant and increase the probability that the panel seams will leak.

It is clear that there is a need for floating clips for standing seam roof assemblies that will permit the maximum amount of expansion and contraction travel of the panels with temperature changes, while also minimizing the clip dimensions and reducing costs.

SUMMARY OF INVENTION

A floating clip for a standing seam roof, the standing seam roof having roof panels interconnected by a standing seam, the sliding clip having a clip base and a clip tab, the clip tab having an upper portion that is configured to engage the standing seam of the standing seam roof. The clip tab is connected to the clip base for relative sliding movement between it and the clip base along a travel path. Pairs of interfering base stops, supported by the clip base, and tab stops, supported by the clip tab, determine the length of the relative travel between the clip tab and clip tab, the total such travel distance being up to substantially the sum of the lengths of the clip base and the clip tab.

That is, the improved sliding clip of the present invention provides a clip tab that adapted to be slidably supported by a clip base for sliding along a travel path the length of which being a selected range along the full length of the clip base so that the length of the travel path can be greater than the greater of the length of either the clip base or the clip tab. Stop members on the clip base and on the clip tab are positioned to abut when the clip tab is moved in either one direction along the travel path. Alternate tang tab stop members can be provided and left in an inoperative mode during manufacture to be selectively activated or made operative as required at and installation site.

The features and advantages of the present invention will become apparent from the following description of the preferred embodiments and claims when read in conjunction with the drawings.

BRIEF DESCRIPTION OF THE DRAWINGS

The drawings present exemplary views of preferred embodiments constructed in accordance with the present invention, unless otherwise stated, and the drawings, insofar as common elements are incorporated therein, utilize common numbers in the various drawings to denote such elements.

FIGS. 8 through 8C are perspective views of yet one other embodiment of a sliding clip constructed in accordance with the present invention; FIG. 8 is an exploded view thereof; FIG. 8A is a view with the clip tab in a neutral position on the clip base; FIG. 8B is a view with the clip tab extended maximally at one end of the clip base; and FIG. 8C is a view with the clip tab extended maximally at the other end of the clip base.

DESCRIPTION

Fixed and floating clips are integral parts of most metal panel roofs with runs over about 40 or 50 feet in length. Fixed and floating clips are used in various combinations to attach the metal roof panels to the underlying structure without creating excessive stress or strain in the structure with the occurrence of differential movement (expansion and contraction) between the panels and the support structure. Such differential movement is especially in play once insulation has been installed between the metal panels and the underlying support structure.

The longer the panel run, or the greater the differential temperature, the greater the slide distance required between the clip tabs and the clip bases. Thus, it is desirable to have floating clips with greater slide capability to accommodate these forces without sacrificing other desirable characteristics, such as ease of erection and use, and also without sacrificing low cost.

Floating clips have spaced apart stops between which the clip tabs travel, the stops preventing separation of the clip tabs from their clip bases, as well as separation of the clip tabs (and thus the standing seams) from the underlying support structure. In general, past practice in designing floating clips has been to provide for equal movement of the clip tab along the clip base in both directions from the center of the clip base.

Figure 1:
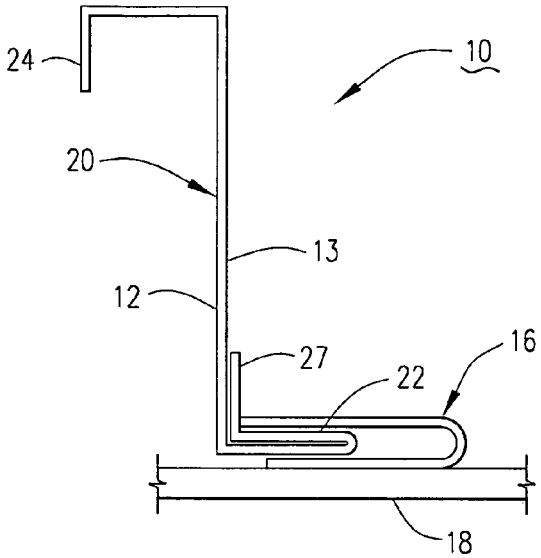
FIG. 1 PRIOR ART
FIG. 1 is a partial, end elevational view of a typical prior art sliding clip for standing seam roof assemblies.
Figure 2:
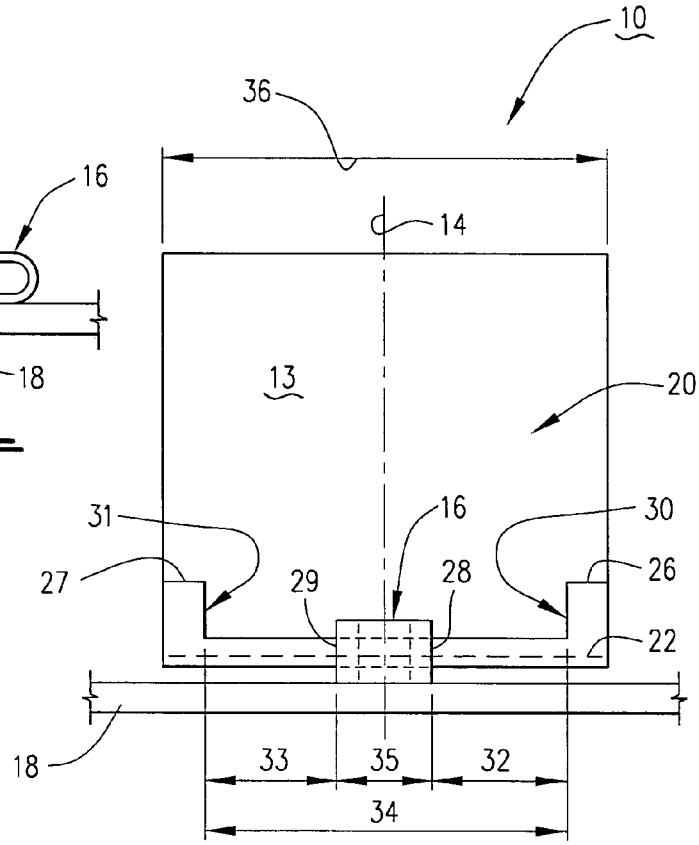
FIG. 2 PRIOR ART
FIG. 2 is an elevational end view of the sliding clip of FIG. 1.

FIGS. 1 and 2 illustrate a typical prior art floating clip for a standing seam roof. Shown therein is a floating clip 10, and for purposes of illustration, the side of the floating clip 10 having a male hold down side 12, and an opposing side 13. It will be noted that the floating clip 10 is generally symmetrical about a vertical, center axis 14.

The floating clip 10 has a clip base 16, and the vertical axis 14 represents the center thereof. The clip base 16 is attached to an underlying support member 18 via self tapping screws (not shown), the underlying support structure 18 usually being a purlin or joist of a building under construction. A clip tab 20 is interconnected at its lower end via overlapping edges configured to form a sliding track 22 for the clip base 16.

The floating clip 10 has an upper hook portion 24 extending from the clip tab 20 and configured to attach over the male portion of a standing seam (not shown) of the metal panels of the standing seam roof. A range of permitted relative movement between the clip base 16 and the clip tab 20, along the sliding track 22, is desired when the panels and underlying support structure 18 are subjected to differential expansion/contraction as a result of environmental conditions. This relative movement is achieved by the sliding movement of the clip tab 20 on the clip base 16.

The elements of the clip base 16 and the clip tab 20 that serve to limit the sliding path of clip base 16/clip tab 20 are: a first or right tab stop 26 and a second or left tab stop 27; and a first or right base stop 28 on one edge of the clip base 16 and a second or left base stop 29 on the opposing edge of the clip base 16.

Dual interfering stop pairs are provided to determine the length of relative travel between the base 16 and the clip tab 20, as follows: the right tab stop 26 and the right base stop 28 form a first or right interfering stop pair 30, and the left tab stop 27 and the left base stop 29 form a second or left interfering stop pair 31. As used herein for convenience of reference, the terms "right" and "left" are the reader's right and left as the reader views FIG. 2.

Starting from when the base 16 is centered relative to the center axis 14 (as depicted in FIG. 2), the right interfering stop pair 30 (the right tab stop 26 and the right base stop 28) determine a right travel distance 32 that the clip tab 20 can travel to the right, and the left interfering stop pair 31 (the left tab stop 27 and the left base stop 29) determine a left travel distance 33 that the clip tab 20 can travel to the left, relative to the clip base 16. With the distance between the right and left tab stops 30, 31 being a clip slide path 34, the clip base 16 having a clip base length 35, and the clip tab 20 having a clip tab length 36, the total travel of the clip tab 20 relative to the base 16 is the length of the clip side path 34 minus the clip base length 35, the total travel being substantially less than the total clip tab length 36. In the prior art clip 10, the amount of relative travel of the clip tab 20 on the base 16 is the difference between the length of clip slide path 34 less the base length 35, and the total travel is confined within, and is less than, the clip tab length 36.

Figure 3:
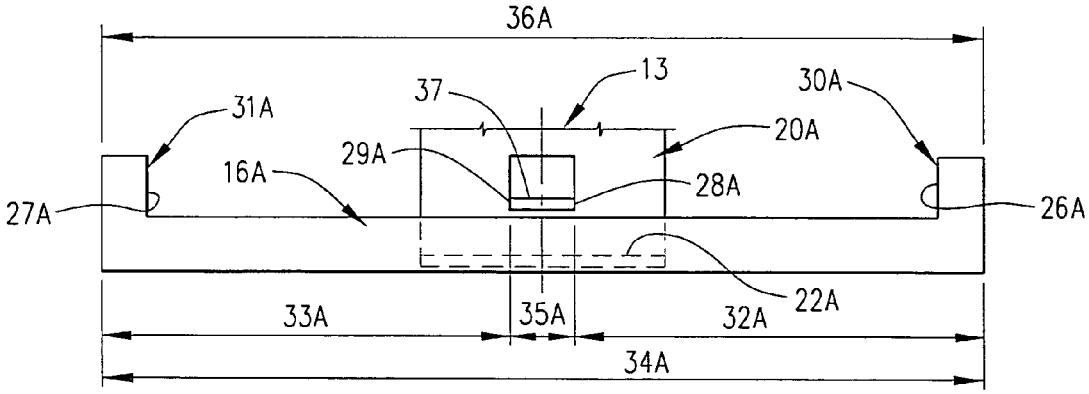
FIG. 3 PRIOR ART
FIG. 3 is a semi-detailed view of another prior art sliding clip for standing seam roofs, the clip tab and the clip base being partially shown.
Figure 4:
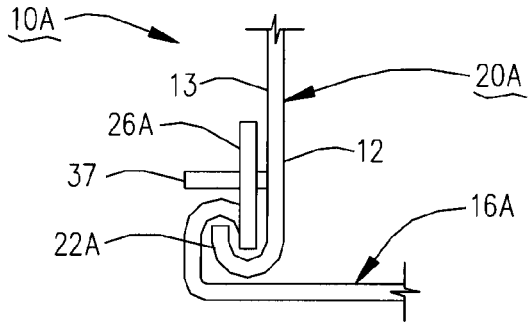
FIG. 4 PRIOR ART
FIG. 4 is an elevational end view the sliding clip of FIG. 3.

Another prior art floating clip 10A is shown in FIGS. 3 and 4, the floating clip 10A having a clip base 16A that is longer than its clip tab 20A, which is slidingly supported on the clip base 16A via a slide track 22A. The clip tab 20A has a clip tang or protrusion 37 that is cut from, and is bent to extend from, the clip tab 20A substantially perpendicularly to side 13A. The clip tang 37 serves to restrain the clip tab 20A between right and left base stops 26A and 27A that are elements of the base 16A. A clip slide path 34A is defined between the inner edges of the base stops 26A and 27A.

Since the relative travel is determined by a dual pair of interfering stop pairs in the same manner as described for the floating clip 10, and the outer and inner stops are comparative, similar numbers with an added suffix letter will be used to designate the operative stops. A first or right base stop 26A and a first or right tab stop 28A (one edge of the tang 37) form a first or right interfering stop pair 30A; and a second or left base stop 27A and a second or left tab stop 29A (the opposing edge of the tang 37) form a second or left interfering stop pair 31A. As above, the terms "right" and "left" are the reader's right and left as the reader views FIG. 3.

Starting from when the base 16A is centered relative to the center axis 14A of the clip tab 20A, the right interfering stop pair 30A (the right base stop 26A and the right tab stop 28A) determine the right travel distance 32A that the clip tab 20 can travel to the right, and the left interfering stop pair 31A (the left base stop 27A and the left tab stop 29A) determine the left travel distance 33A that the clip tab 20A can travel to the left, relative to the clip base 16A. With the distance between the right, left base stops 26A, 27A, respectively, being the length of the clip slide path 34A, the clip tang 37 having a clip tang length 35A (along the slide track 22A), and the base 16A having a clip base length 36A, the total travel of the clip tab 20A relative to the base 16A is the length of the clip slide path 34A minus the clip tang length 35A, the total travel being substantially less than the clip base length 36A. In the prior art clip 10A, the amount of relative travel of the clip tab 20A on the base 16A is the difference between the slide path length 34A minus the tang length 35A, and this total travel is confined within, and is less than, the base length 36A.

In past practice, clip tabs were generally erected in such a manner that the clip tab was temporarily held in a neutral position while the clip was being attached to the underlying structure. Only after installation was the clip tab free of restraint and able to move in either of two directions as required by the forces of panel expansion and contraction. The coordinated slide stops that define clip slide travel extended wholly from the hold down side or on the opposite side of the clip, but not from both sides. The clip base in past clips has usually been located at the clip centerline to provide equal clip slide travel in both directions.

In the prior art clip 10 of FIGS. 1 and 2, clip slide travel is limited by the slide stops 26, 27 located on the clip tab 20, and by one or more coordinated elements located on the clip base 16, thereby permitting clip tab travel between the stops 26, 27. The floating clip 10A of FIGS. 3 and 4 has the slide stops 26A, 27 located on the clip base 16A, and the coordinated clip tang 37 extends from the clip tab 20A to prevent travel past the base slide stops 26A, 27A. The length of slide travel of the clip tab 20A is the length of the clip slide path 34A minus clip tang length 35A.

For both the floating clip 10 of FIGS. 1-2 and the floating clip 10A of FIGS. 3-4, clip slide in either direction is limited to less than half the length of the clip slide path 32 or 32A, and in each of these clips, the total slide is less than the total length of the supporting clip base.

Figure 5:
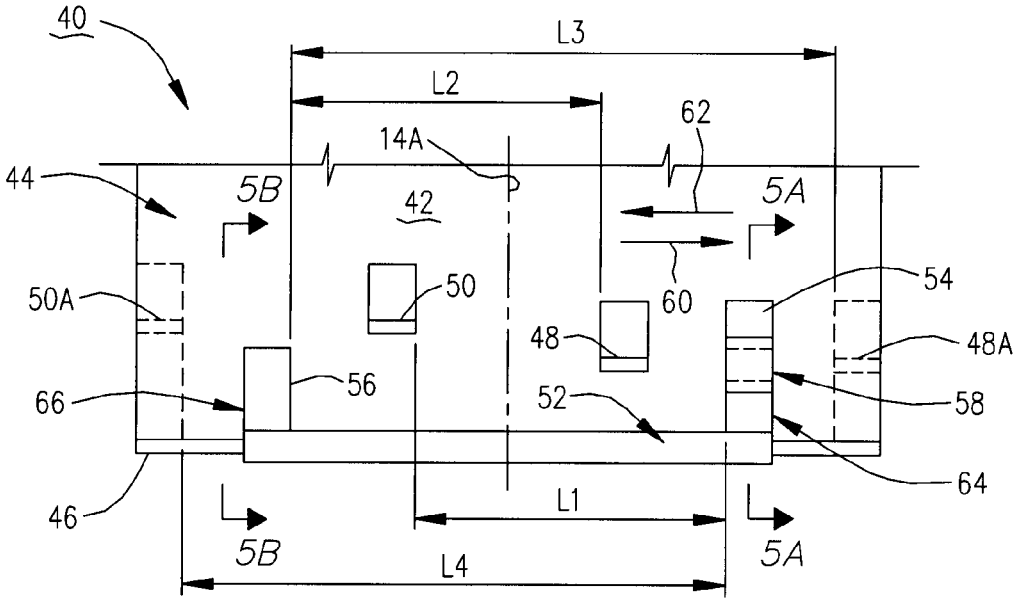
FIG. 5 is an elevational view of a sliding clip constructed in accordance with the present invention, the clip tab thereof partially shown.
Figure 5A:
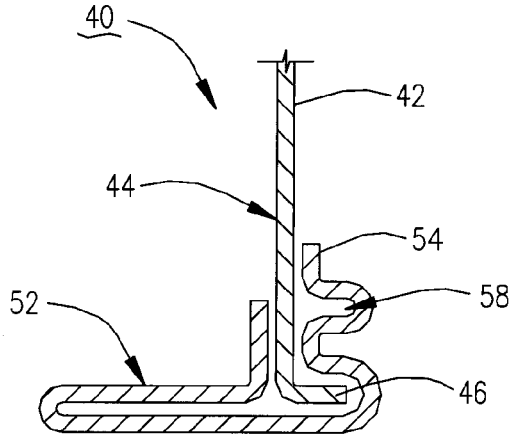
FIG. 5A is an elevational view of one end of the sliding clip of FIG. 5.
Figure 5B:
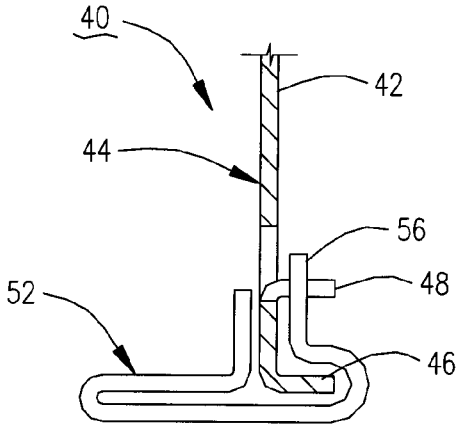
FIG. 5B is an elevational view of the other end thereof.

FIGS. 5, 5A and 5B show a floating clip 40 that is constructed in accordance with the present invention. As discussed above, it is desirable that a floating clip achieve maximum slide travel along the base clip without allowing such slide travel to cause the clip tab to disengage, slide off the clip base or fail under uplift forces, and yet accommodate longer panel runs without creating stress and strain in the structure. The floating clip 40 of FIG. 5 utilizes a non-symmetrical slide configuration wherein portions of the right and left clip edges overlap the ends of the clip base at points along the slide path to achieve much greater slide travel than heretofore provided.

In FIG. 5, a view of clip 40 from side 42, the clip 40 has a clip tab 44 with a lower edge forming a slide track 46. A first or right tang or protrusion forms a right tab stop 48, and a second or left tang or protrusion forms a left tab stop 50, cut and extending from, the clip tab 46 and located at different heights above a clip base 52 that is connected to the clip tab 44 via the slide track 46. The clip base 52 has a first or right base stop 54 and a second or left base stop 56 extending upwardly and configured individually with different shapes.

The right base stop 54 is shaped differently from the left base stop 56, the right base stop 54 extending upwardly substantially parallel to the clip tab 44. The right base stop 54 is configured to have a clearance gap 58 positioned to allow the right tab stop 48 to clear the right base stop 54 as the clip tab 44 moves in a first or right direction 60 and yet extends to a sufficient height so that the left tab stop 50 strikes the right base stop 54 after the right tab stop 48 has passed through the clearance gap 58 to clear past the right base stop 54. The left base stop 56 is configured in a shape that allows the left tab stop 50 to clear the left base 56 as the clip tab 44 moves in a second or left direction 62 and yet is configured so that the right tab stop 48 strikes the left base stop 56 after the left tab stop 50 has cleared the left base stop 56.

The right and left base stops 54, 56, together with the right and left tab stops 48, 50, cooperate to form dual interfering stop pairs to establish the length of relative travel between the base 16 and the clip tab 20, as follows: a first or right interfering stop pair 64 (the right base stop 54 and the left tab stop 50); and second or left interfering stop pair 66 (the left base stop 56 and the right tab stop 48). As the terms "right" and "left" are used for convenience of reference, and refer to the reader's right and left, respectively, consistent with the right and left directions 60, 62.

The slide travel distance can be selectively determined by altering distances L1 (the distance between the right base stop 54 and the left tab stop 50, which are the right interfering stop pair 64) and L2 (the distance between the left base stop 56 and the right tab stop 48, which are the left interfering stop pair 66), as measured when the clip tab 44 is centered on the clip base 52.

FIG. 5A is a partial sectional view through clip 40 at section 5A. FIG. 5B is a partial sectional view at section 5B of the clip 40 after clip tab 44 has moved in the direction 62 until the right tab stop 48 has come into contact with the left base stop 56, with the left tab stop 50 and the right base stop 54 omitted for clarity.

A first tang or protrusion, to form an alternate right tab stop 48A, and a second tang or protrusion, to form an alternate left tab stop 50A, are depicted by broken lines in FIG. 5 to demonstrate the ease of varying the slide travel lengths in both direction 60 and direction 62. Clip travel in direction 60 can be increased by forcing the right tab stop 48 to an inoperative position, thereby causing the alternate right tab stop 48A to take its place as the slide travel stop on that end of the clip 40. This can be performed during manufacturing or during erection of the roof.

During manufacture, one or both of the right tab stops 48, 48A can simply be left out of the clip tab 44 and formed at the installation site. Alternatively, both right tab stops 48 and 48A can be formed, but not made operative, that is not bent to extend, during manufacture, and at the installation site, one of the protrusions 48, 48A can be bent to extend from the clip tab 44 to make it operative as appropriate to the need of the application.

In like manner, clip travel in direction 62 can be increased by forcing the left tab stop 50 to an inoperative position, thereby causing the alternate tab stop 50A to take its place as the slide travel stop on that end of the clip 40. This can also be performed during manufacturing or during erection of the roof. During manufacture, one or both of the left tab stops 50, 50A can simply be formed but not bent to extend, and the desired one of these bent at the installation site.

Alternatively, both of the left tab stops 50, 50A can be formed but not bent during manufacture, and at the installation site, one of the left tab stops 50, 50A can be folded to extend during the erection process. And as stated herein above, the slide travel in either direction can be selectively determined and/or altered by changing the distance L3 (between the left base stop 56 and the right tab stop 48A) and/or distance L4 (between the right base stop 54 and the left tab stop 50A).

While only one pair of alternate right and left tab stops 48A, 50A are shown formed in the clip tab 44 of the clip 40, it will be appreciated any number of such tab stops can be formed during manufacture, and once the clips are at the installation site, workmen can select and bend such tab stops as may be applicable for a particular installation and desired length of the travel path for the relative movement of the clip tab 44 to the clip base 52.

Figure 6:
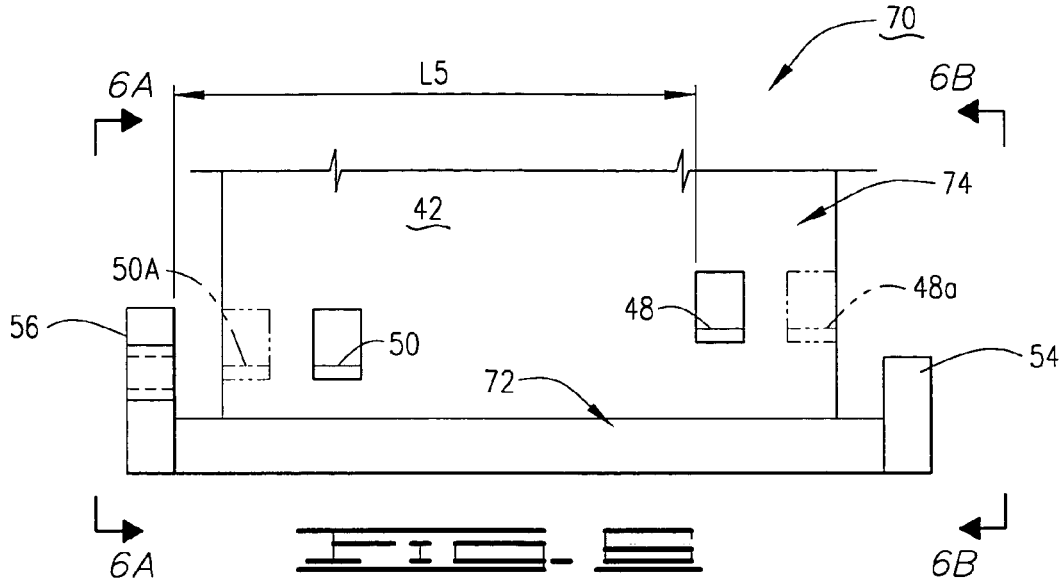
FIG. 6 is an elevational side view of another embodiment of a sliding clip constructed in accordance with the present invention, the clip tab and the clip base partially shown.
Figure 6A:
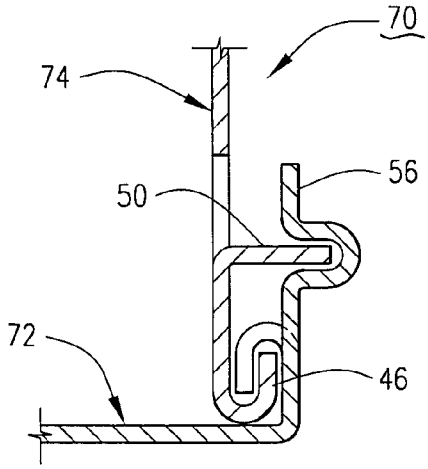
FIGS. 6A and 6B are elevational views of opposing ends of the sliding clip of FIG. 6.
Figure 6B:
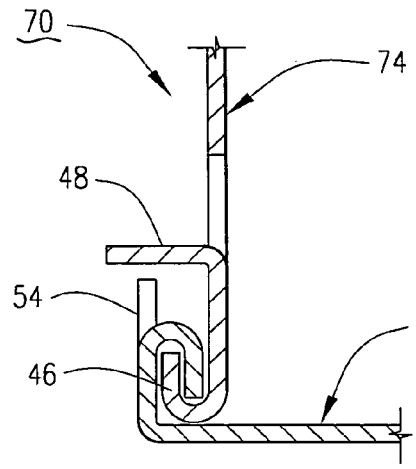

FIGS. 6, 6A and 6B show a floating clip 70 also constructed in accordance with the present invention wherein the clip slide asymmetry is similar to that of the clip 40, so like numbers are used to designate like elements. However, the length of clip base 72 exceeds the length of clip tab 74. It is desirable in some situations to vary the relation of the clip tab 74 and base 72 to optimize the clip for such factors as strength and cost. As above, the travel distance between the base stops and the tab stops, such as L5, (the distance between the left base stop 56 and the right tab stop 48) can be established as required for any particular field application.

FIGS. 7, 7A, 7B and 7C are views of another floating clip 80 constructed in accordance with the present invention in which the asymmetry relating to the slide/stop mechanism occurs on opposite sides of the clip 80 when viewed from its end. That is, one set of corresponding base stops and tab stops is on side 82, and one set is on side 84 of the clip 80.

The clip 80 has a clip base 86 and a sliding clip tab 88. For convenience of reference and clarity, like numbers will be used where applicable in the description of the clip 80 as those used for the clip 40. Thus, the clip 80 has a first tab stop 48 and a second tab stop 50, each extending from opposing sides 82, 84, respectively, and the clip 80 has a first base stop 54 and a second base stop 56, each supported by the clip base 86 on opposing sides 84, 82, respectively, of the clip 80.

The first tab stop 48, extending from side 82 of clip tab 88, cooperates with the second base stop 56 formed on the clip base 86 to act as one pair of interfering stop elements to limit the slide travel of clip tab 88 in one direction 62. The second tab stop 50, extending from side 84 of clip tab 88, and the first base stop 54 formed on the clip base 86 act as another pair of interfering stop elements to limit the slide travel of the clip tab 88 in the opposite direction 60. A panel support member 90 is formed on the clip base 86 for the purpose of supporting a panel corrugation (not shown) of the standing seam roof panel to which the floating clip 80 is attached.

The clip tab 88 can slide the distance denoted as length L1 (in FIG. 7, the distance between the second base stop 56 and the first tab stop 48) in direction 62, or it can slide the distance denoted as length L2 (in FIG. 7A, the distance between the first base stop 54 and the second tab stop 50) in direction 60. It should be noted that the total travel distance (L1 and L2) is greater than the length of either the clip tab 88 or the clip base 86 separately. This clip slide travel far exceeds that of previous clips, the slide travel of which is limited to less than half of the longest of the clip tab or the clip base.

Figure 7:
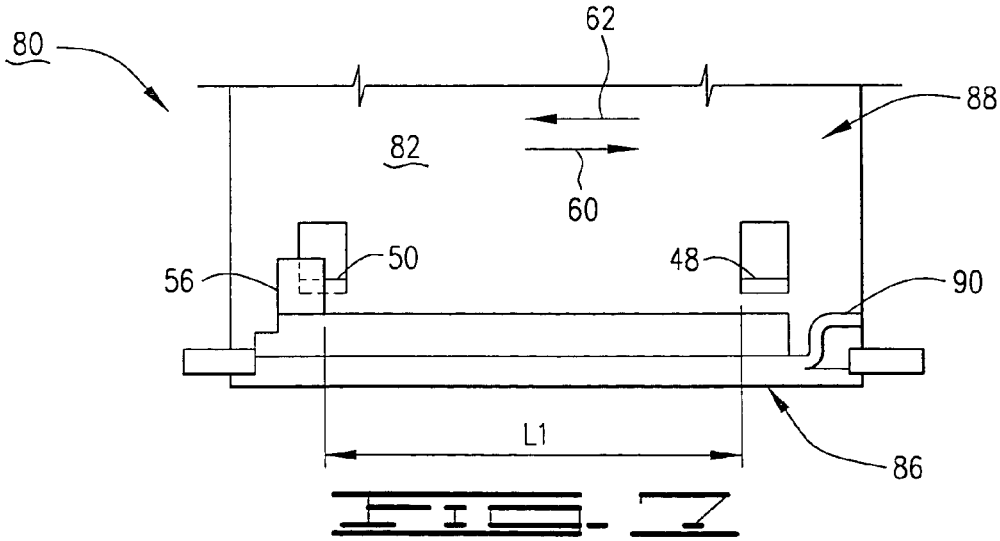
FIG. 7 is an elevational view of one side of another embodiment of a sliding clip constructed in accordance with the present invention, the clip tab thereof being partially shown.
Figure 7A:
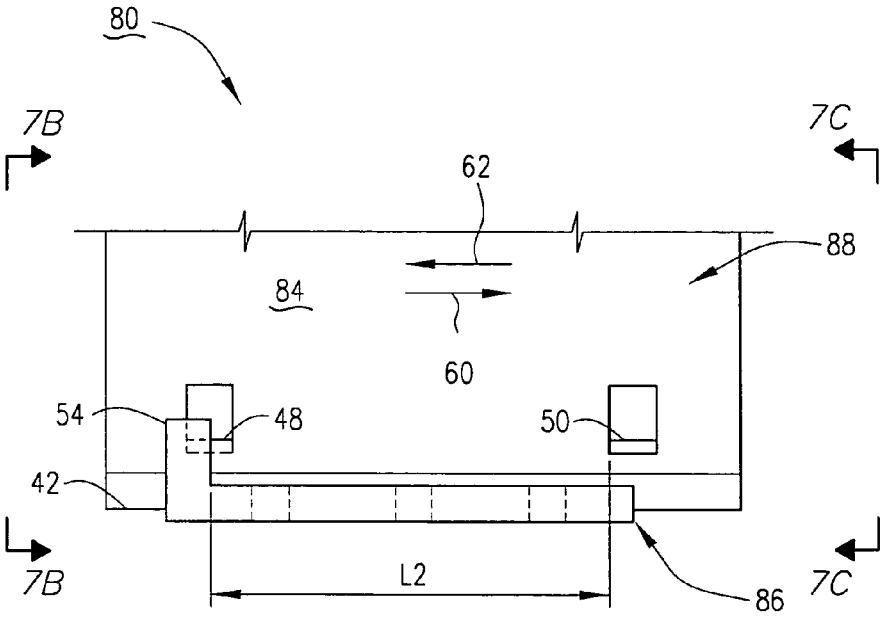
FIG. 7A is an elevational view of the other side thereof.
Figure 7C:
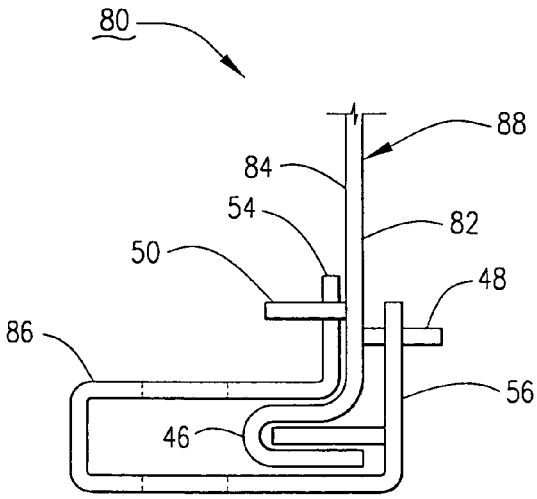
FIG. 7C is an elevational view corresponding to a cross-section at 7C-7C.
Figure 7B:
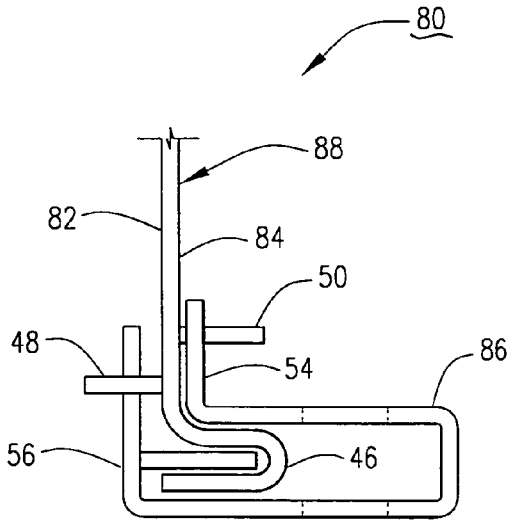
FIG. 7B is an elevational view corresponding to a cross-section of the sliding clip of FIG. 7 at 7B-7B.
Figure 3:
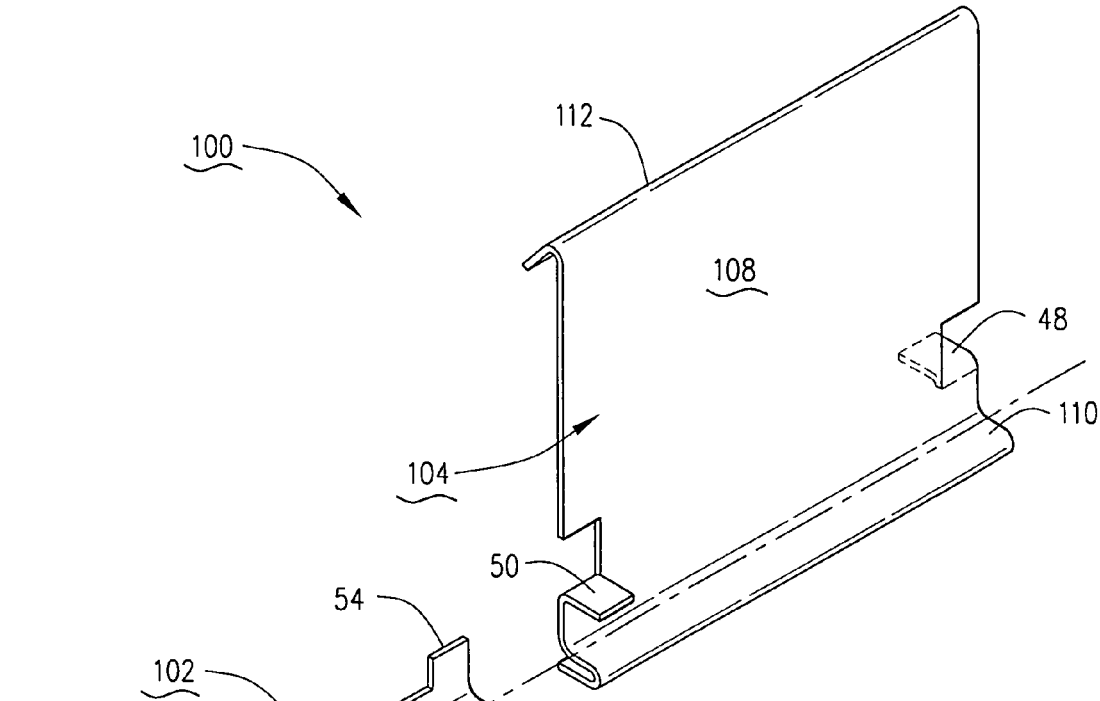
Figure 3A:
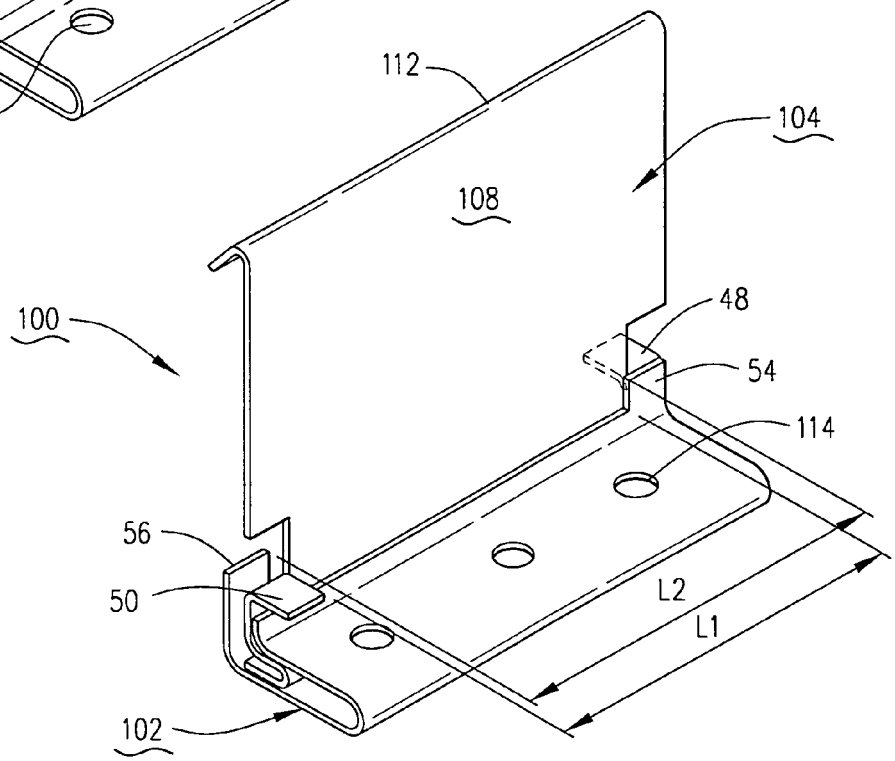
Figure 5B:
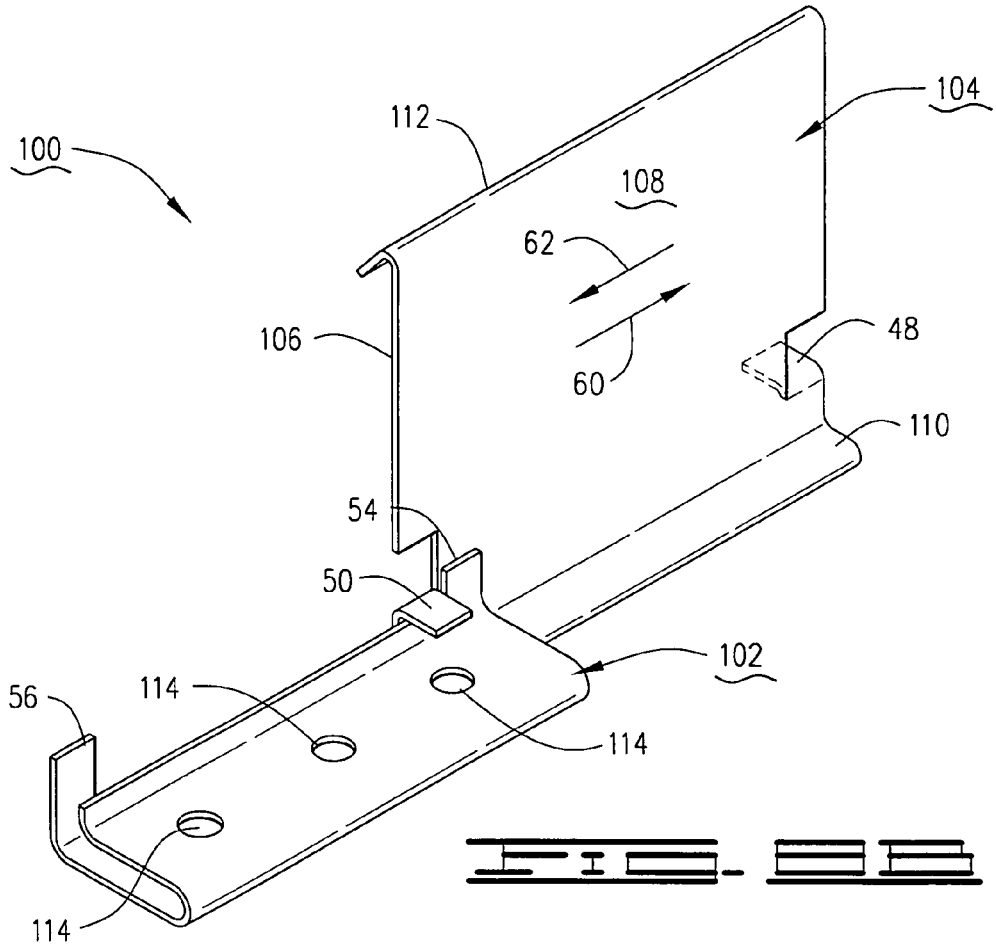
Figure 5C:
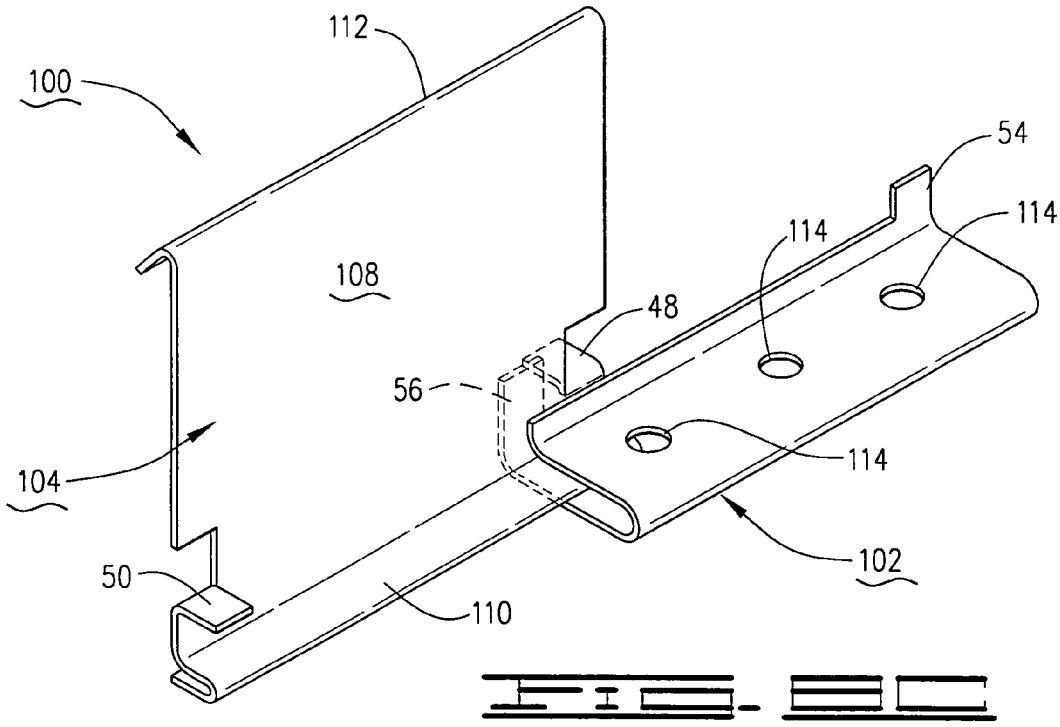

While a single pair of right and left tab stops 48, 50 are shown in FIGS. 7 through 7B, it will be appreciated that the clip tab 74 also can be provided with a plurality of alternate tab stops formed during manufacture but left in an inoperative state until the clips are received at an installation site. Once the clips are at the installation site, workmen can select and bend such tab stops as may be applicable for a particular installation and desired length of the travel path for the relative movement of the clip tab 74 to the clip base 72.

The present invention will now be described with reference to FIGS. 8 through 8C, which are views of yet another floating clip 100 constructed in accordance with the present invention in which the asymmetry relating to the slide/stop mechanism occurs on opposite sides of the clip 100. That is, the clip 100 has a clip base 102 and a sliding clip tab 104, and one set of corresponding base stops and tab stops is on side 106 of the clip tab 104, and one set is on the other side 108 thereof.

For convenience of reference and clarity, like numbers will be used where applicable in the description of the clip 100 for the embodiments described herein above, such as the clip 80. Thus, the clip 100 has a first tab stop 48 and a second tab stop 50, each extending from opposing sides 106, 108, respectively, and the clip 100 has a first base stop 54 and a second base stop 56, each supported by the clip base 102 on opposing sides 106, 108, respectively, of the clip 100.

The clip tab 104 and the clip base 102 are interconnected by a rolled slide track 110 that permits relative sliding movement of the clip tab 104 and the clip base 102, while holding the clip tab 104 and the clip base 102 in close alignment. The clip tab 104 has an upper hook portion 112 that is configured to attach over, and engage with, a standing seam of interconnected adjacent roof panels (not shown).

The first tab stop 48, extending from side 106 of clip tab 104, cooperates with the second base stop 56 formed on the clip base 102 to act as one pair of interfering stop elements to limit the slide travel of clip tab 104 in one direction 62.

The second tab stop 50, extending from side 108 of clip tab 104, and the first base stop 54 formed on the clip base 102 act as another pair of interfering stop elements to limit the slide travel of the clip tab 104 in the opposite direction 60.

The clip tab 104 can slide the distance denoted as length L1 (the distance between the second base stop 56 and the first tab stop 48) in direction 62, or the clip tab 104 can slide the distance denoted as length L2 (the distance between the first base stop 54 and the second tab stop 50) in direction 6*o*. The total travel distance (L1 and L2) of the clip tab 104 is greater than the length of either the clip tab 104 itself or the clip base 102 separately. Thus, the slide travel of the clip tab 104 of the clip 100 far exceeds that of any previous clip, since the total movement accommodated by prior art floating clips has been limited to less than half of the longest of the clip tab or the clip base.

The clip base 102 is provided with several attachment holes 114 to secure the clip 100 to a purlin understructure via fasteners (not shown) extending there through. When installed with the clip tab 104 attached to a standing seam of interconnected roof panels (not shown), as pointed out above, the length of slide travel provided by the clip 100 is substantially equal to the sum of the lengths of the clip tab and clip base (such clip movement diminished only by the dimensions of the inner, or inboard, stop members), thereby far exceeding that provided by prior art sliding clips.

While a single pair of right and left tab stops 48, 50 are shown in FIGS. 8 through 8C, it will be appreciated that the clip tab 104 also can be provided with a plurality of alternate tab stops formed during manufacture but left in an inoperative state until the clips are received at an installation site. Once the clips are at the installation site, workmen can select and bend such tab stops as may be applicable for a particular installation and desired length of the travel path for the relative movement of the clip tab 104 on the clip base 102.

It is clear that the present invention is well adapted to carry out its objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings.

What is claimed is:

1. A clip for a standing seam roof, the standing seam roof having roof panels interconnected by a standing seam, the sliding clip comprising:

a base member;

a member slidably supported by the base member and configured to connect to the standing seam;

means for determining the length of the slide path to extend up to substantially the sum of the lengths of the clip base member and the slidable member in either of opposing directions along the slide path.

2. The clip of claim 1 wherein the means for determining comprises:

a pair of stop members disposed to restrict relative movement between the base member and the slidable member, the pair of stop members supported by the base member and the slidable member to determine extension between the base member and the slidable member in a first direction.

3. The clip of claim 2 wherein the means for determining comprises:

a second pair of stop members disposed to restrict relative movement between the base member and the slidable member, the second pair of stop members supported by the base member and the slidable member to determine extension between the base member and the slidable member in a second direction.

4. The clip of claim 3 wherein the first pair of stop members comprises:

a base stop supported by the base member; and a tab stop supported by the slidable member.

5. The clip of claim 4 wherein a plurality of tab stops are supported by the slidable member so that a selected one of the tab stops can be made operable to form the tab stop of the first pair of stop members to determine the length of permitted extension of the slidable member on the slide path in the first direction.

6. The clip of claim 4 wherein a plurality of tab stops are supported by the slidable member so that a selected one of the tab stops can be made operable to form the tab stop of the second pair of stop members to determine the length of permitted extension of the slidable member on the slide path in the second direction.

7. The sliding clip of claim 1 wherein the means for determining the length is configured to permit extension of the slidable member from each end of the clip base while preventing separation therefrom.

8. A floating clip for a standing seam roof, the standing seam roof having roof panels interconnected by a standing seam, the sliding clip comprising:

a clip base;

a clip tab having an upper portion configured to engage the standing seam;

means for connecting the clip tab to the clip base for sliding movement of the clip tab in a travel path;

means for determining the length of the travel path to extend for a distance up to substantially the sum of the lengths of the clip base and the clip tab in either of opposing directions along the travel path.

9. The sliding clip of claim 8 wherein the means connecting the clip tab to the clip base is further characterized as being configured to permit extension of the clip tab from one end of the clip base while preventing separation thereof.

10. The sliding clip of claim 9 wherein the means connecting the clip tab to the clip base is further characterized as being configured to permit extension of the clip tab from another end of the clip base while preventing separation thereof.

11. In a standing seam roof for a building having a roof with adjacent roof panels supported by underlying support structure and joined by a standing seam, an improved sliding clip comprising:

a clip base adapted to be attached to the support structure;

a clip tab configured to be connected to the standing seam;

a slidably interlocking joint between the clip tab and the clip base adapted to permit sliding movement of the clip tab along a slide path on the clip base; and means for limiting the travel path so that the clip tab is permitted to travel a selected distance along the full length of the clip base so that the length of the slide path can be greater than the length of the longest of the clip base and the clip tab in either of opposing directions along the slide path.

12. The sliding clip of claim 11 wherein the means for limiting the slide path comprises:

a first pair of interfering stop members comprising:

a base stop supported by the clip base; and a tab stop supported by the clip tab, the base stop and the tab stop disposed to contact each other when the relative movement between the clip tab and the clip base occurs in a direction toward one end of the slide path.

13. The sliding clip of claim 12 wherein the means for limiting the travel path further comprises:

a second pair of interfering stop members comprising:

a second base stop supported by the clip base; and a second tab stop supported by the clip tab, the second base stop and the second tab stop disposed to contact each other when the relative movement between the clip tab and the clip base occurs in a second direction toward the other end of the slide path.

14. The clip of claim 13 in which the base stops are formed integrally with the clip base.

15. The clip of claim 14 in which the tab stops are formed integrally with the clip tab.

16. The clip of claim 11 in which a plurality of tab stops are formed integrally with the clip tab, each tab stop being selectively positionable in an operative position and in an inoperative position to determine the extent of the travel path.

17. In a standing seam roof assembly in which roof panels are supported by underlying support structure in overlapping edge relationship to form a standing seam assembly, an improved clip comprising:

a clip base;

a clip tab slidingly supported by the clip base along a slide track; and means for determining the permitted travel distance of the clip tab along the slide track, said means having at least two pairs of interfering slide stops, each pair of interference slide stops having one stop member on the clip base and one element on the clip tab, the stop members of each pair of interfering slide stops disposed to permit sliding extension of the clip base and clip tab to each other along the slide track in a selected one of a first and second direction so that said travel distance can be is up to greater than the length of the longest of the clip base and the clip tab.

18. The improved clip of claim 17 in which the base stops are formed integrally with the clip base.

19. The improved clip of claim 18 in which the tab stops are formed integrally with the clip tab.

20. The improved clip of claim 19 in which a plurality of tab stops are formed integrally with the clip tab, each tab stop being selectively positionable in an inoperative position and in an operative position, the operative position being when the tab stop forms one element of one of the pairs of the interfering slide stops.

21. A clip for a standing seam roof, the standing seam roof having roof panels interconnected by a standing seam, the sliding clip comprising:

a base member having a right edge and a left edge, the base member having a right base stop and a left base stop;

a tab member configured to connect to the standing seam, the tab member having a right tab stop and a left tab stop;

means for interconnecting the base member and the tab member so that the tab member is moveable along the base member in a right direction and in a left direction, and whereas the right tab stop is allowed to pass the right edge of the base member until the left tab stop abuts the right base stop, and whereas the left tab stop is allowed to pass the left edge of the base member until the right tab stop abuts the left base stop.

22. The clip of claim 21 wherein the right tab stop is on a first side of the tab member and the left tab stop is on a second side of the tab member.

23. The clip of claim 22 wherein the right base stop is adjacent the first side of the tab member and the left base stop is adjacent the second side of the tab member.

24. The clip of claim 23 wherein the tab member has a plurality of tab stops are supported so that a selected one of the tab stops can be made operable to form the first tab stop and another selected one of the tab stops can be made operable to form the second tab stop.

25. The sliding clip of claim 24 wherein the means for interconnecting permits extension of the clip tab from each end of the clip base while preventing separation therefrom.

* * * * *